US010487631B2

(12) United States Patent
Fidalgo et al.

(10) Patent No.: US 10,487,631 B2
(45) Date of Patent: Nov. 26, 2019

(54) PUMP FOR EXTRACTING WATER, PETROLEUM, OR OTHER FLUIDS

(71) Applicants: Daniel Rodolfo Lopez Fidalgo, Benavidez-Buenos Aires (AR); Luis Alfonso Pabon Pernia, Capital Federal (AR)

(72) Inventors: Daniel Rodolfo Lopez Fidalgo, Benavidez-Buenos Aires (AR); Luis Alfonso Pabon Pernia, Capital Federal (AR)

( * ) Notice: Subject to any disclaimer, the term of this patent is extended or adjusted under 35 U.S.C. 154(b) by 79 days.

(21) Appl. No.: 14/510,658

(22) Filed: Oct. 9, 2014

(65) Prior Publication Data

US 2015/0101793 A1 Apr. 16, 2015

(30) Foreign Application Priority Data

Oct. 11, 2013 (AR) ..... 2013 0103723

(51) Int. Cl.
*E21B 43/12* (2006.01)
*F04B 47/02* (2006.01)
*F04B 47/04* (2006.01)

(52) U.S. Cl.
CPC ..... *E21B 43/127* (2013.01); *F04B 47/026* (2013.01); *F04B 47/04* (2013.01)

(58) Field of Classification Search
CPC .... E21B 43/127; E21B 17/00; E21B 17/1071; E21B 43/124; E21B 43/129; F04B 47/026; F04B 47/12; F04B 47/02; F04B 9/103
USPC ..... 166/241.2, 68, 72, 105–105.6; 417/358
See application file for complete search history.

(56) References Cited

U.S. PATENT DOCUMENTS 3,479,958 A * 11/1969 Anderson ..... F04B 47/00 417/437
4,305,461 A * 12/1981 Meyer ..... E21B 33/03 166/77.4
4,848,085 A * 7/1989 Rosman ..... F04B 47/04 166/68
2005/0226752 A1* 10/2005 Brown ..... F04B 47/02 417/555.1
2005/0265875 A1* 12/2005 Williams ..... F04B 39/0011 417/555.1
2007/0193735 A1* 8/2007 Farquharson ..... E21B 43/129 166/88.1
2007/0261841 A1* 11/2007 Fesi ..... E21B 43/126 166/105
2012/0080199 A1* 4/2012 Wilson ..... F04B 47/02 166/372

* cited by examiner

*Primary Examiner* — David Carroll
(74) *Attorney, Agent, or Firm* — Defillo & Associates; Evelyn A Defillo

(57) ABSTRACT

A pump for extraction of water, petroleum or other fluids from thousands of meters of depth is a reciprocating pump that reduces the incidence of piston seizures and, furthermore, gas locks that block fluid from entering the pump. When the pump is introduced into a well casing or tubing, a sleeve of the pump latches to the well casing or tubing and allows a hollow piston to travel therein in a reciprocating motion for fluid extraction. A traveling valve is located in the hollow piston and fixed valve is seated in the well casing or tubing. The sleeve length is less than the length of the hollow piston. In a preferred embodiment, passages are provided for releasing gases.

4 Claims, 6 Drawing Sheets

PUMP FOR EXTRACTING WATER, PETROLEUM, OR OTHER FLUIDS

TECHNICAL FIELD

The present invention relates to a pump for extracting water, petroleum and other fluids from sources up to thousands of meters below ground, and in particular, to reciprocating pumps.

BACKGROUND

Pumping systems having a reciprocating movement for permitting the upstrokes and downstrokes of the pumps have been known for a long time. The great majority of those pumping systems use a combination of a piston having a short length and a corresponding traveling valve. Such a piston travels within a cylindrical body, a so-called barrel, having a considerable length relative to the piston. A fixed valve is located at the lower extremity of the barrel.

It is understood that such traveling and fixed valves are required in the downstroke phase, to enable the chamber of the piston being filled with the fluid being extracted and, in the upstroke phase, to lift the fluid with the piston.

Often, the fluid being extracted contains sand, drillings or other abrasive solids. The solids can become lodged in the annulus between the external wall of the piston and the internal surface of the barrel, thereby displacing the piston relative to the barrel. The solids are then drawn along the length of the stroke of the piston. In view of the pressure of the column of fluid being extracted, for example at 200 $kg/cm^2$, the solids can cause wear through abrasion. Moreover, the piston may even lock or seize against the barrel, thereby requiring the fluid extraction operation to be stopped.

SUMMARY OF THE INVENTION

Consequently, a first object of the present invention is to solve the aforementioned problem of the piston locking up or seizing as a result of sand, drillings or similar elements becoming lodged in the annulus between the piston and the barrel, furthermore, to reduce abrasion wear on the pump.

An obvious solution would be to increase the clearance between the piston and the barrel so that the solids do not cause the piston to lock up. However, this is not possible without adversely affecting the efficiency of the pump.

Accordingly, a pump of the present invention is actuated by-a pumping string communicating with a connecting rod moved by a conventional pumping apparatus. The pump is adapted to be introduced within a casing or tubing and has a sleeve that can be attached or sealed to the casing or tubing. A hollow piston is slidably received within the sleeve. An upper traveling valve is located within the piston and cooperates with a lower fixed valve that is seated in the casing or tubing. In accordance with the present invention, the length of the sleeve is less than the length of the hollow piston.

The piston is coaxially located with the sleeve and slides within the sleeve in response to upstroke and downstroke movement by a pumping rod or string.

However, sand, drillings or other solids are not pulled into the annulus between the hollow piston and the sleeve as occurs during upstroke and downstroke operation of conventional prior art pumps.

In the present invention, the length of the piston will determine the maximum length of the stroke of the pump.

While the annulus between the piston and the sleeve is comparable to the annulus between the piston and barrel of the prior art, because the piston is longer than the sleeve, the annulus over the length of the remainder of the pump is larger between the piston and the casing or tubing. Accordingly, any suspended solids in the fluid will be less likely to become lodged, and, therefore, locking or seizing of the piston is greatly diminished.

When the piston is in an upstroke phase, the very movement of the piston will release any build-up of sand, drillings or other solids that might occur between the piston and the sleeve.

In a downstroke phase, the traveling valve is open, so that there is no pressure differential between the column of fluid to be lifted and the bottom of the pump. Consequently, ingress of sand, drillings or other solids between the sleeve and the piston is less likely to occur.

In a first embodiment of the present invention, a sleeve is formed in the casing or tubing. In a second embodiment of the present invention, a sleeve is sealed or attached to the casing or tubing by means of an attachment liner or collet. In this embodiment, the sleeve can be raised by the piston for any required pump maintenance.

In another embodiment of the present invention, passages are provided in a lower portion of the sleeve, so that any gases in the fluid being extracted will not cause a gas lock.

BRIEF DESCRIPTION OF THE DRAWINGS

The pump of the present invention will be better understood by referring to the following detailed description of preferred embodiments and the drawings referenced therein, in which.

DETAILED DESCRIPTION OF THE INVENTION

Figure 1A:
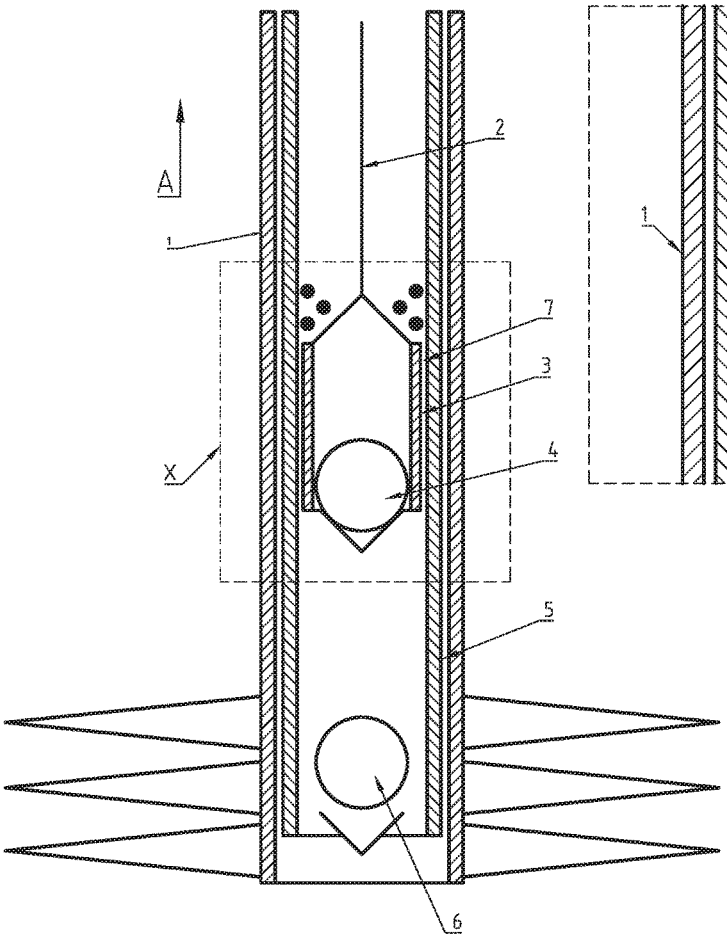
FIG. 1A is a cross section view of a well having a PRIOR ART pump for extracting oil, water and other fluids in an upstroke phase.
Figure 1B:
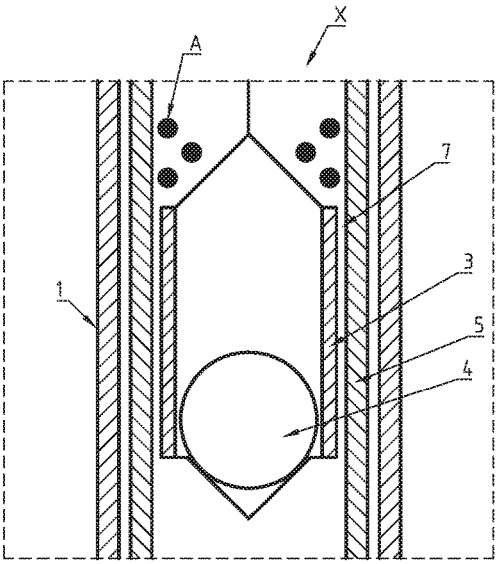
Fig. 1B PRIOR ART
FIG. 1B is an enlarged view of detail "X" of FIG. 1A.

FIGS. 1A and 1B illustrate a pump of the prior art used for petroleum extraction. A pump is introduced into a well casing 1. A rod string 2 of the pump is driven reciprocally, the rod string 2 being connected to a hollow piston 3 having a corresponding traveling valve 4. The traveling valve 4 is closed during an upstroke phase, as depicted by arrow "A". The hollow piston 3 slides inside a long barrel 5. A fixed valve 6 is located at the lower extremity of the barrel 5. As shown in FIG. 1A, the length of the hollow piston 3 is significantly less than the length of the barrel 5 in which the hollow piston 3 travels.

FIG. 1B, which is an enlarged view of detail "X" in FIG. 1A, schematically illustrates the presence of solids "a", such as sand, drillings or other abrasive elements, which are drawn into the annulus 7 between the hollow piston 3 and the barrel 5, when the piston moves in an upstroke phase, depicted by arrow "A." These solids "a" can cause the hollow piston 3 to seize or lock up against the barrel 5, as discussed above.

Figure 2A:
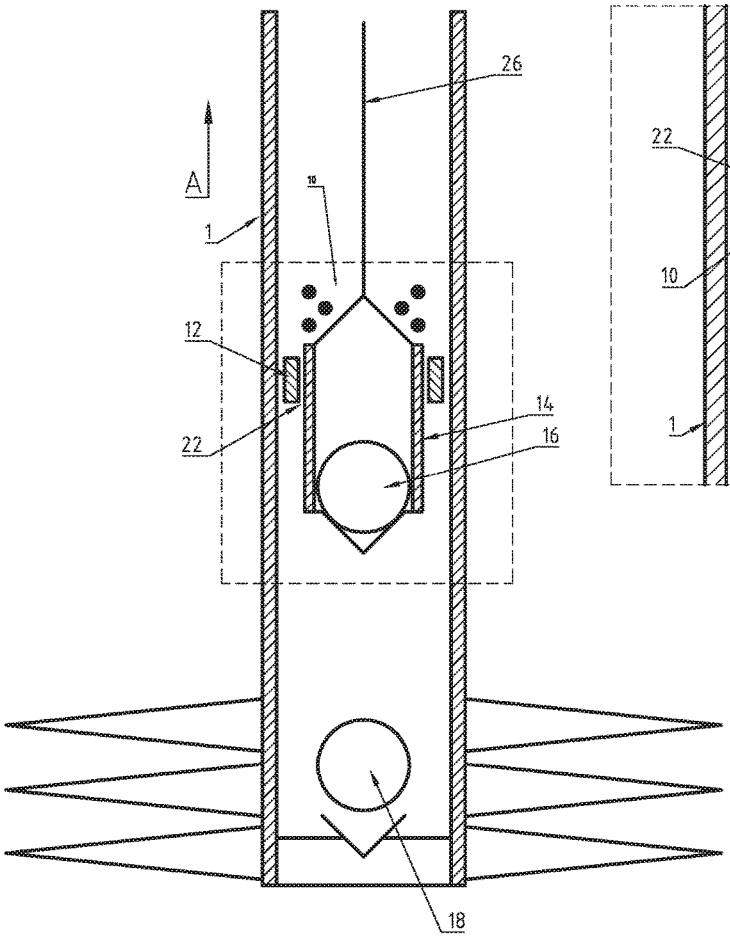
FIG. 2A is a longitudinal cross section view of a well and one embodiment of a pump according to the present invention during an upstroke phase, where an upper traveling valve is in a closed position and a lower fixed valve is in an open position.
Figure 2B:
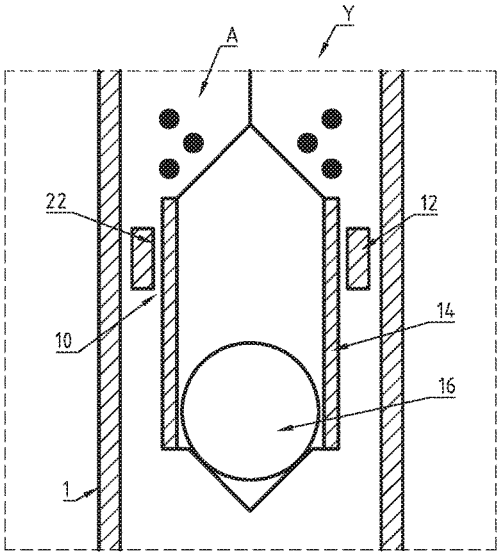
FIG. 2B is an enlarged view of detail "Y" of FIG. 2A.

FIGS. 2A and 2B illustrate one embodiment of a pump 10 according to the present invention that overcomes the disadvantages of the prior art pump of FIGS. 1 A and 1B. As shown in FIG. 2A, pump 10 of the present invention is illustrated in place in a well casing 1. The pump 10 has a sleeve 12 that has an inside diameter that is less than the inside diameter of the well casing 1. The pump 10 of the present invention also has a hollow piston 14 that is longer than the sleeve 12 in which the hollow piston 14 travels. The hollow piston 14 is preferably greater than 2.5 times the length of the sleeve 12, more preferably in a range from 2.5 times to 5 times the length of the sleeve 12.

Although the sleeve 12 of the embodiment in FIGS. 2A and 2B is formed as a unitary structure with the casing 1, it is also possible, in another embodiment, to attach the sleeve 12 as an annular body to the casing 1. This embodiment is shown in FIGS. 3, 4, 5A and 5B. As in the prior art pumps, the hollow piston 14 has a traveling valve 16 and fixed valve 18.

FIGS. 2A and 2B show, in contrast to the Prior Art in FIGS. 1 and 1B, the pump 10 in an upstroke phase, depicted by Arrow "A." FIG. 2B, which is an enlarged view of detail "Y" in FIG. 2A, shows abrasive solids 'a' are not drawn into the annulus 22 between the hollow piston 14 and the sleeve 12 and moreover, the action of the upstroke of the hollow piston 14, entrains in the fluid any solids 'a' built up on the upper edge of the sleeve 12.

Figure 3:
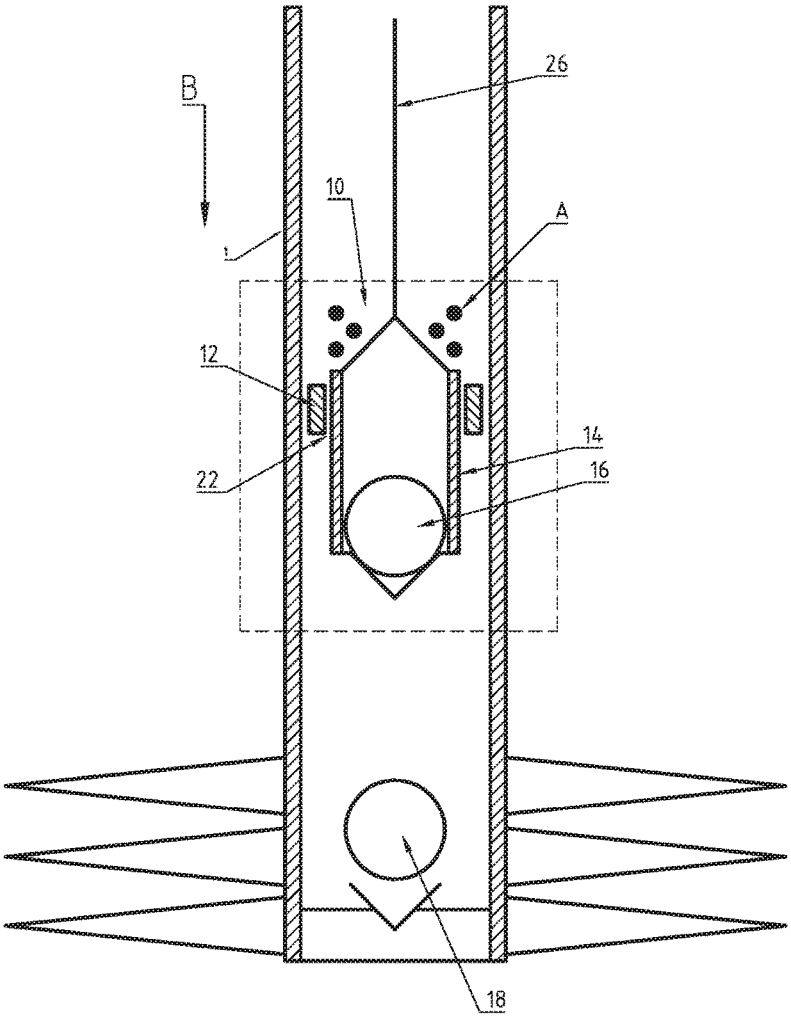
FIG. 3 is a longitudinal cross section view of the pump of FIG. 2A during a downstroke phase, where the upper traveling valve is in an open position, and the lower fixed valve is in a closed position.

In FIG. 3, the hollow piston 14 may be observed in a downstroke phase (direction of arrow 'B'), wherein the traveling valve 16 is open and, consequently, there is no pressure differential between the fluid flowing into the hollow piston 14 and the fluid above the fixed valve 18, that would promote the ingress of the abrasive solids 'a' into the annulus 22 between the hollow piston 14 and the sleeve 12.

Figure 4:
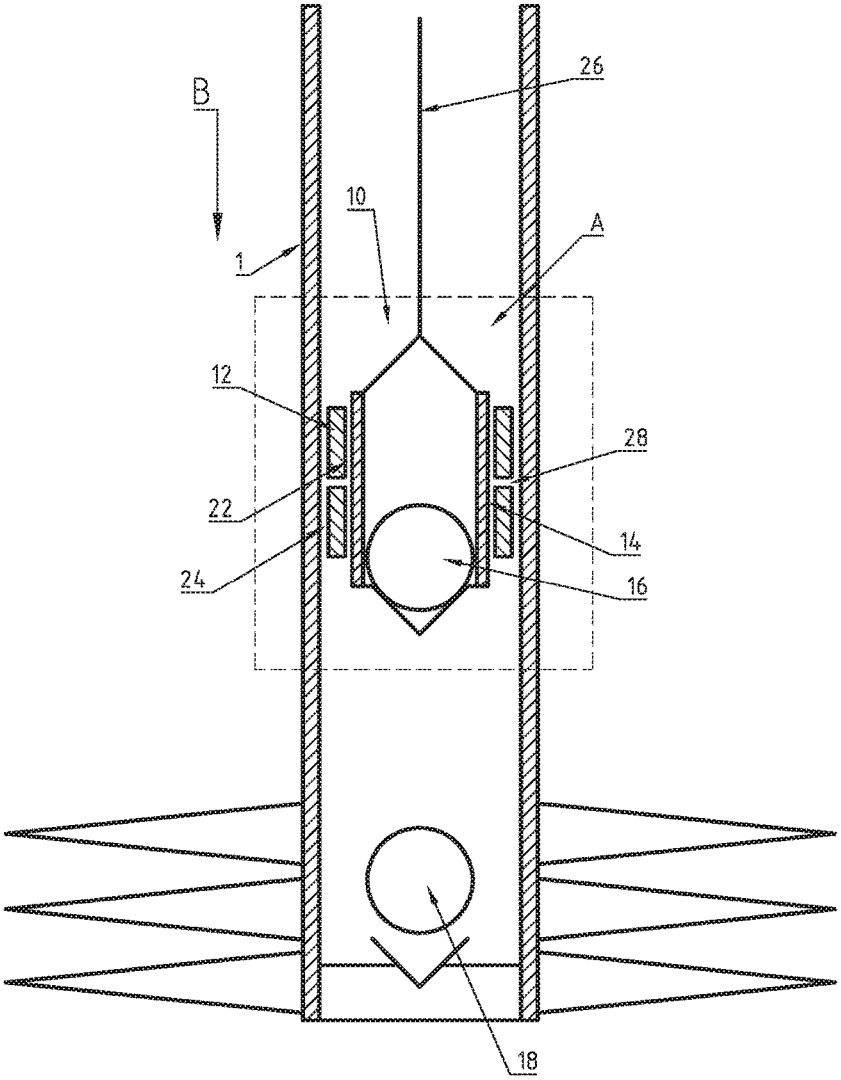
FIG. 4 is a longitudinal cross section view of a well and another embodiment of the pump according to the present invention, having passages for removal of gases present in the fluid being extracted.

FIG. 4 illustrates the pump 10 in an upstroke phase (depicted by arrow 'A'). In this embodiment, the sleeve 12 has a lower portion 24 having the same outer diameter but a larger inside diameter having passages 28 therethrough, permitting communication of the gases present in the fluid with the annulus 24, thereby avoiding gas locks that can cause the traveling valve 16 and/or the fixed valve 18 to not operate as desired.

Figure 5A:
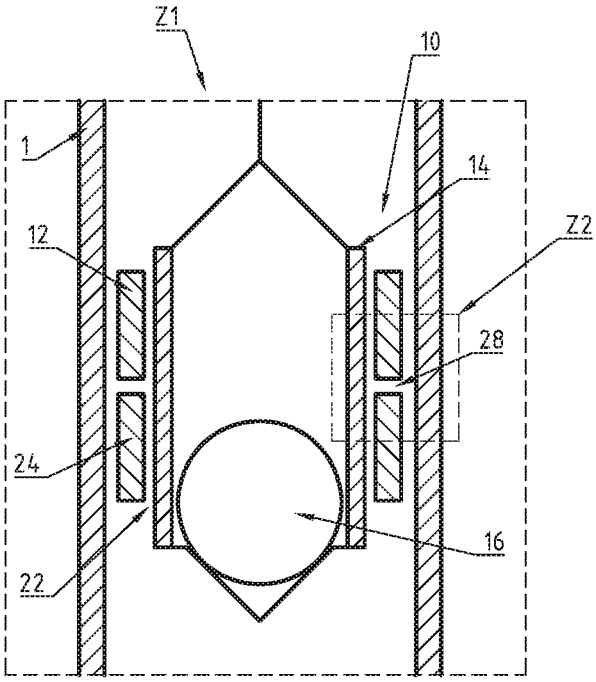
FIG. 5A is an enlarged view of detail "Z1" of FIG. 4.
Figure 5B:
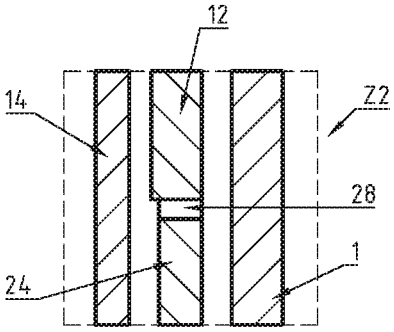
FIG. 5B is an enlarged view of detail "Z2" of FIG. 5.

FIG. 5A illustrates the detail "Z1" of FIG. 4, while FIG. 5B illustrates the detail "Z2" of FIG. 5A.

Figure 6:
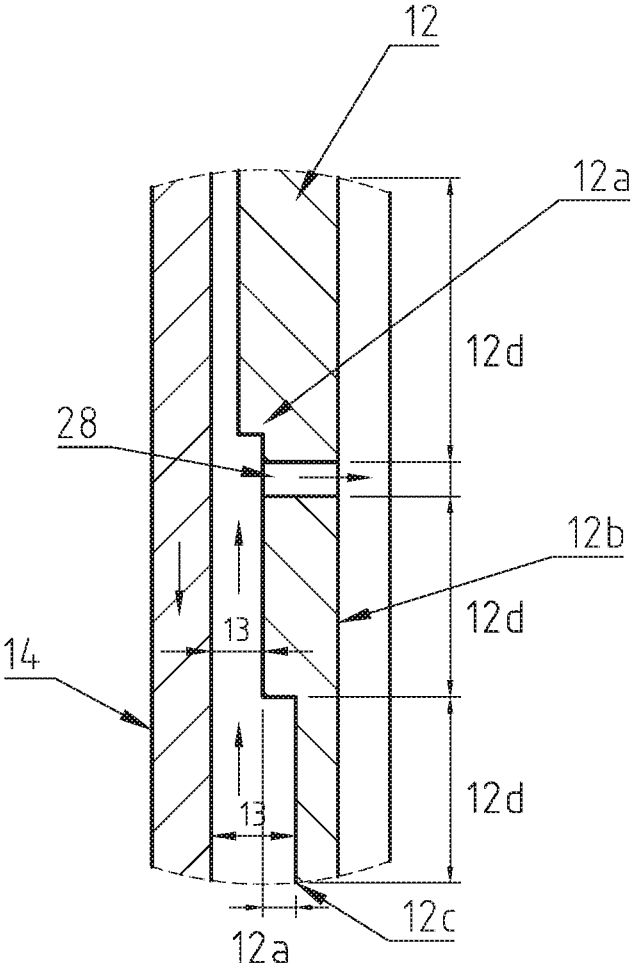
FIG. 6 is an enlarge view of the pump according to the present invention showing the step formed on the inner wall of the sleeve.

FIG. 6 shows that the sleeve includes an outer wall 12*b* and an inner wall 12*c*, the inner wall have sections 12*d*, each section increases in width in an ascending direction with regard to an adjacent section forming a step 12*a*, thus an annular space 13 between the piston and the sleeve is reduced as the width of each section increases.

METHOD OF OPERATION

In use, the pump 10 is inserted into a well casing or tubing 1. In the embodiment where the sleeve 12 is a unitary structure with the well casing or tubing 1 (as shown in FIGS. 2A and 2B), the pump is lowered until the piston 14 is slidably received into the sleeve 12. In the embodiment where the sleeve 12 is not a unitary structure with the well casing or tubing 1 (as shown in FIGS. 3, 4, 5A and 5B), sleeve 12 is lowered with the piston 14 and latched or sealed to the well casing or tubing 1, with an attachment liner or collet (not shown). The fixed valve 18 is seated in the well casing or tubing 1 in a manner known to those skilled in the art. In the operation of the pump 10 of the present invention, a conventional pumping apparatus (not shown) at the wellhead generates a pull that is transmitted to the pumping rod 26 (as shown in FIG. 4) and, from the pumping rod 26, to the hollow piston 14 that slides within the sleeve 14, which may be of a unitary structure with the well casing or tubing 1 (as shown in FIGS. 2A and 2B) or a separate component that is sealed or attached to well casing or tubing 1. When the hollow piston 14 is pulled upwardly in the upstroke phase, the traveling valve 16 closes to lift the fluid being extracted, as well as generating a vacuum to open fixed valve 18 to draw subsurface fluid into the well casing through the open fixed valve 18.

In the downstroke phase of the pump 10, the hollow piston 14 is pushed downwardly by the pumping rod 26 (as shown in FIG. 3), causing the fixed valve 18 to close and the traveling valve 16 to open, pushing the fluid being extracted through the traveling valve 16 into the hollow piston 14.

Any gases present in the fluid being extracted can escape into the well casing or tubing 1, so gas locks can be avoided and the hollow piston 14 can generate a sufficient draw to open the fixed valve 18.

Specific measurements, diameters and lengths of the components of the pump 10 of the present invention-will be determined by those skilled in art depending on the type of fluid being extracted, whether water, petroleum or any other fluid.

The invention claimed is:

1. A reciprocating pump for extracting water, petroleum, and other fluids actuated by a pumping rod moved by a pumping apparatus, the pump being introduced within a casing of a well, the reciprocating pump comprising:

a sleeve adapted for attachment to the casing;

a hollow piston slidably received within the sleeve, the hollow piston having a length that is longer than a length of the sleeve;

a traveling valve operably disposed in the hollow piston; and a fixed valve adapted to be seated in the casing below the traveling valve;

wherein because the length of the piston is longer than the length of the sleeve, an annulus formed between the piston and the sleeve is smaller than an annulus formed over a remainder length of the piston and the casing;

wherein the sleeve includes an outer wall and an inner wall, the inner wall has internal sections, each internal section increases in width in an ascending direction with regard to an adjacent internal section; each internal section includes a first portion forming a first step and a second portion forming a second step, reducing an annular space between the piston and the sleeve in the ascending direction, wherein the second portion includes horizontal passages that cross the second step and communicate with a chamber that stores gases produced by the fluid in the sleeve;

wherein the horizontal passages serve to expel the gases present on the fluid to an exterior side of the sleeve.

2. The pump as claimed in claim 1, wherein the hollow piston is greater than 2.5 times the length of the sleeve.

3. The pump as claimed in claim 1, wherein the hollow piston is in a range from 2.5 times to 5 times the length of the sleeve.

4. The pump as claimed in claim 1, wherein the sleeve is a unitary structure with the casing.

* * * * *